US011351772B2

(12) United States Patent
Herring

(10) Patent No.: US 11,351,772 B2
(45) Date of Patent: Jun. 7, 2022

(54) PRINTING ON TO A 3-DIMENSIONAL ARTICLE

(71) Applicant: Trichord Ltd., Farnham (GB)

(72) Inventor: Peter Richard Herring, Farnham (GB)

(73) Assignee: TRICHORD LTD., Farnham (GB)

( * ) Notice: Subject to any disclaimer, the term of this patent is extended or adjusted under 35 U.S.C. 154(b) by 18 days.

(21) Appl. No.: 16/062,148

(22) PCT Filed: Dec. 14, 2016

(86) PCT No.: PCT/GB2016/000217
§ 371 (c)(1),
(2) Date: Jun. 14, 2018

(87) PCT Pub. No.: WO2017/103555
PCT Pub. Date: Jun. 22, 2017

(65) Prior Publication Data

US 2018/0370221 A1 Dec. 27, 2018

(30) Foreign Application Priority Data

Dec. 14, 2015 (GB) ..... 1522004

(51) Int. Cl.
*B41F 16/00* (2006.01)
*B41M 5/035* (2006.01)
*B41M 5/025* (2006.01)

(52) U.S. Cl.
CPC ..... *B41F 16/008* (2013.01); *B41F 16/0046* (2013.01); *B41M 5/035* (2013.01); *B41M 5/0358* (2013.01); *B41M 5/0256* (2013.01)

(58) Field of Classification Search
CPC ... B41F 16/008; B41F 16/0046; B41M 5/035; B41M 5/0256
See application file for complete search history.

(56) References Cited

U.S. PATENT DOCUMENTS 4,670,084 A 6/1987 Durand
4,681,034 A * 7/1987 Schulzen ..... D06B 11/0076 101/211

(Continued)

FOREIGN PATENT DOCUMENTS

GB 2442824 A 4/2008
GB 2470195 A 11/2010

(Continued)

OTHER PUBLICATIONS

Search Report from GB Application No. 1522004.9 dated Jun. 12, 2017.

(Continued)

*Primary Examiner* — Matthew G Marini
*Assistant Examiner* — Marissa Ferguson-Samreth
(74) *Attorney, Agent, or Firm* — Hamre, Schumann, Mueller & Larson, P.C.

(57) ABSTRACT

A process for printing on to a 3-dimensional article is described. An image is printed on to a first side of a stretchable carrier membrane having a first side and a second side. The membrane is mounted in a plane within a frame between a heating chamber defined on one side of the membrane, and an article receiving chamber defined on the other side of the membrane. A 3-dimensional article to be printed is placed on to a generally flat platen positioned generally parallel to the said plane, optionally with a nest for the article thereon, within the article receiving chamber. A thermo- and vacuum-forming step is performed in which there is relative movement of the platen with respect to the membrane in a direction perpendicularly to the said plane to bring the article into register with the image printed on the membrane and to carry the article into intimate contact with the membrane through the said plane into the heating chamber. A source of vacuum is applied to the membrane (Continued)

from the said other side, and heat is applied to the membrane from the said one side at a first temperature sufficient to soften the membrane, whereby the membrane is thermo- and vacuum-wrapped at least partially about the article with the membrane in intimate contact with surface details of the article. A dye-diffusion step is performed in which infra-red radiation is applied to the article with the membrane wrapped therearound using at least two infra-red sources to heat the membrane and underlying surface of the article over substantially a half-spherical solid angle uniformly to a temperature in excess of the first temperature and for a time sufficient to cause the printed image to diffuse into the surface of the article but insufficient to damage the article.

16 Claims, 2 Drawing Sheets

(56) References Cited

U.S. PATENT DOCUMENTS

| | | | | |
|---|---|---|---|---|
| 5,308,426 | A | 5/1994 | Claveau | |
| 2002/0131062 | A1 | 9/2002 | Neri et al. | |
| 2010/0220169 | A1 | 9/2010 | Howell et al. | |
| 2010/0245523 | A1 | 9/2010 | Howell | |
| 2014/0225955 | A1* | 8/2014 | Perez Gellida | B41J 11/002 347/17 |
| 2017/0096733 | A1* | 4/2017 | Sasaki | C23C 28/042 |

FOREIGN PATENT DOCUMENTS

| | | | | | |
|---|---|---|---|---|---|
| JP | H04-314524 | | | 11/1992 | |
| JP | 2010186178 | A1 | | 8/2010 | |
| JP | 2015134466 | | * | 7/2015 | B44C 1/17 |
| JP | 2015134466 | A | | 7/2015 | |
| WO | 0196123 | | * | 12/2001 | B41M 5/0358 |
| WO | 02096661 | | * | 12/2002 | B41M 5/52 |
| WO | 2004022354 | | * | 3/2004 | B41M 5/035 |
| WO | 2007049070 | A1 | | 5/2007 | |
| WO | 2009001034 | A1 | | 12/2008 | |
| WO | 2010038089 | A1 | | 4/2010 | |

OTHER PUBLICATIONS

International Search Report from International Application No. PCT/GB2016/000217 dated Mar. 1, 2017.
Third party observations filed on Applicant's parallel British Patent application GB1522004.9, dated May 1, 2020.
Third party observations that filed on Applicant's parallel British Patent Application No. GB1522004.9.

* cited by examiner

PRINTING ON TO A 3-DIMENSIONAL ARTICLE

CROSS-REFERENCE TO RELATED APPLICATION

This Application is the National Stage filing under 35 US.C. § 371 of PCT Application Ser. No. PCT/GB2016/000217 filed on Dec. 14, 2016. The disclosure of the PCT Application is hereby incorporated herein by reference in its entirety.

BACKGROUND

This disclosure relates to methods and apparatus for printing on to a 3-dimensional article.

There have been many proposals over the years for printing on to 3-dimensional articles. Such printing has historically been most successful when the article is no more than slightly curved. Printing to the edge of even a simple article like a cover for a mobile phone, where the edge regions are curved through a right angle from an almost planar face, presents a problem. Printing on to the whole exposed surface of an article such as a motorcycle helmet or a bowling ball without shading or distortion or on to more complex articles such as a toy gun with sharp surface relief or a canvas sports shoe, is very much more difficult.

Previous attempts have included applying dye to a flexible membrane, heating that membrane to soften it, moving the softened membrane down into contact with the article to be printed, the article being held on a generally flat platen, optionally on a nest, holding the membrane and the article in contact, optionally using a vacuum, and heating the membrane and article until the dye is transferred from the membrane to the article.

Moderate success can be achieved using methods similar to this, but it is difficult to achieve even wrapping of the membrane around the entirety of the article, especially when applying dye to deep articles such as shoes or motorcycle helmets, rather than to generally flat articles such as a mobile phone case. Membranes tend to stretch unevenly, causing a distortion in the printed image. Even if a simple image or a single colour is chosen, as soon as dye needs to be applied to more than one surface of an article, it is very difficult to obtain an even colour across the entirety of the article, due to stretched membranes and variations in temperature during the dye transfer stage.

Another significant issue lies in accurate placement of the chosen image. It is difficult to position the image exactly where it is needed on the article. As a consequence, the industry has often tolerated an error margin of a few centimetres or few millimetres as still acceptable. However, where designs are to be applied to a series of modular parts to create an overall effect, or where they must be precisely applied such as centrally on an article for reasons of symmetry or in order to align with precise details of the article's shape, errors of only millimetres can result in products that are no longer saleable, resulting in unacceptable wastage.

Neri et al (US2002/0131062 A1) describes a method and apparatus for printing on to 3-dimensional objects. The process includes placing the objects to be printed upon a platen, placing a carrier sheet containing the (mirror image of the) desired image on to the or each object, and then lowering a further membrane down over the carrier sheets. A vacuum is used to pull the membrane downwards, bringing the carrier sheet(s) into pressure contact with the object (s). A heating chamber on the other side of the membrane applies radiant heat. The combination of pressure and heat transfers the image to the objects. This method of simply moving the membrane to the objects with their superposed carrier sheet(s) can cause problems. The membrane is soft while it is being moved, and stretchable so that there is a real risk of causing an error in the positioning of the carrier sheets relative to their object(s) when the membrane makes contact.

Howell (US2010/0245523 A1) discloses a process for thermal transfer printing in which a membrane serving as a printed carrier sheet is held still, and in which, during a pre-heating step, the object is moved up and into contact with the membrane [paragraph 112]. The membrane is softened by fan driven air passing over heated electric elements in the pre-heating step until it is viscoelastic with very low yield stress. It is said to be initially "loosely draped" over the article until a vacuum is applied while maintaining the heat in a second step. This process may avoid unwanted movement of the entire carrier sheet, but registration is difficult as the very low yield stress and loose draping may cause the desired image on the membrane to distort or move relative to the object prior to application of vacuum.

Hoggard et al (WO 2007/049070) place a 3-dimensional object to be printed in a tray that is significantly deeper than the object and fix a print film across the open top of the tray. Vacuum is applied to the interior of the tray to stretch the film down the sides of the tray and around the article, and a pre-heating step thermoforms the film to the surface of the article. In a second heating step at high temperature, ink from the print film sublimes on to the surface of the article. Sublimation is defined as going from solid to vapour (and vice versa) without passing through the liquid state. Stretching the film down the sides of the tray as well as around the article is likely to have resulted in shading and in registration problems. Significantly, in a later variation of this process, Hoggard proposes in WO 2010/038089 physically clamping his film sheet to the edges of the article to be printed in the bottom of his tray.

SUMMARY OF THE DISCLOSURE

The present disclosure arises from Applicant's work seeking to improve upon existing methods of printing on to 3-dimensional products, in order to improve both the quality of the final products and reliability of the method.

According to a first aspect of this disclosure, a process is provided for printing on to a 3-dimensional article, the process comprising the steps of: printing an image on to a first side of a stretchable carrier membrane having a first side and a second side; mounting the said membrane in a plane within a frame between a heating chamber defined on one side of the membrane, being the said second side thereof, and an article receiving chamber defined on the other side of the membrane, being the said first side thereof; placing a 3-dimensional article to be printed on to a generally flat platen positioned generally parallel to the said plane, optionally with a nest for the article thereon, within the article receiving chamber; performing a thermo- and vacuum-forming step in which there is relative movement of the platen with respect to the membrane in a direction perpendicularly to the said plane to bring the article into register with the image printed on the membrane, and to carry the article into intimate contact with the membrane through the said plane into the heating chamber, a source of vacuum is applied to the membrane from the said other side, and heat is applied to the membrane from the said one side at a first temperature sufficient to soften the membrane, whereby the membrane is thermo- and vacuum-wrapped at least partially about the article with the membrane in intimate contact with surface details of the article; and a dye-diffusion step in which infra-red radiation is applied to the article with the membrane wrapped therearound using at least two, and preferably a plurality in excess of two, of infra-red sources to heat the membrane and underlying surface of the article over substantially a half-spherical solid angle uniformly to a temperature in excess of the first temperature and for a time sufficient to cause the printed image to diffuse into the surface of the article but insufficient to damage the article.

The printing step is preferably performed digitally using a digital micro-piezo head printer to form the image on the carrier membrane as a pattern of pixel dots of dye, but gravure printing, silkscreen printing or lithio-printing may all be used.

Without intending to be bound by this explanation, it is Applicant's belief that where the surface of the article is granular or crystalline, for example in an article formed of metal or plastics, or where the surface is fibrous, for example in an article formed of textile, the infra-red sources cause that surface to open at the grain or crystal boundaries or between the fibres to assist diffusion of dye into the surface of the article. Where an article has no such grain or crystal boundaries, for example in a glass article, the dye cannot readily diffuse into the surface, and so, such articles are pre-treated with a transparent coating of a material that does exhibit grain boundaries and so allows diffusion of the dye into such coating.

The process may include one or more of the following steps: Controlling the heat in the apparatus through the use of baffle(s), fan(s), and/or reflector(s), during the thermo- and vacuum-forming step. Controlling the heat in the apparatus through the use of baffle(s), fan(s), and/or reflector(s) during the dye-diffusion step. Controlling the heat in the apparatus by adjusting the intensity, the position, and/or intermittently switching off the infra-red heat sources during the thermo- and vacuum-forming step. Controlling the heat in the apparatus by adjusting the intensity, the position, and/or intermittently switching off the infra-red heat sources during the dye-diffusion step. Controlling the position of each baffle, reflector or fan in response to feedback from temperature sensors in the apparatus. Controlling the intensity and/or the position of the infra-red heat sources in response to feedback from temperature sensors in the apparatus. Keeping the surface of the article between a predetermined minimum acceptable temperature and a predetermined maximum acceptable temperature during the thermo- and vacuum-forming step. Keeping the surface of the article between a predetermined minimum acceptable temperature and a predetermined maximum acceptable temperature during the dye diffusion step. Forming the membrane from a film with a coating applied onto the first side of the film, the image being printed onto the coating. Tailoring the wavelength (or range of wavelengths) used to the membrane used. Using a membrane that is designed to soften at low temperature. Using a membrane that is designed to hold its structural form when heated. Using a membrane that is designed to stretch in a consistent fashion. Pre-treating the article with a coating tailored to the dye used. Pre-treating the article with a coating tailored to the film used. Pre-treating the article with a coating tailored to the coating used on the film. Pre-treating the article with a coating tailored to the wavelength or range of wavelengths of infra-red radiation used in the heating chamber. The thermo- and vacuum-forming step comprises: pausing or slowing the movement of the platen when the article is around 0.2 mm to 1 cm from the membrane, applying a slight vacuum on the first side of the membrane to draw the membrane to register with the article, then resuming the movement of the platen to pass the article through the said plane, while maintaining the slight vacuum. The thermo- and vacuum-forming step further comprises: creating a stronger vacuum once the article is on the heating chamber side of the said plane. The thermo- and vacuum-forming step further comprises: maintaining the stronger vacuum for a predetermined amount of time while the article is on the heating chamber side of the said plane, then reducing the vacuum to a lower predetermined strength.

In a second and alternative aspect of this disclosure, there is provided an apparatus for printing on to a 3-dimensional article; the apparatus comprising: a heating chamber, an article receiving chamber, and a frame adapted to mount a stretchable carrier membrane having a first side and a second side in a plane separating the heating chamber from the article receiving chamber, the membrane having an image printed on to its first side; a generally flat platen positioned generally parallel to the said plane within the article receiving chamber, the platen optionally having a nest for an article thereon; a mechanism for causing relative movement of the platen with respect to the membrane in a direction perpendicularly to the said plane to bring an article mounted on the platen into register with a said image printed on the first side of a said membrane held in the frame, and to carry the said article into intimate contact with the membrane through the said plane into the heating chamber; a source of vacuum associated with the article receiving chamber and adapted to apply a vacuum to a membrane held in the frame from the side of the article receiving chamber, a first source of heat in the heating chamber adapted to apply heat to a membrane held in the frame at a first temperature sufficient to soften the membrane, whereby to thermo- and vacuum-wrap the membrane at least partially about the said article with the membrane in intimate contact with surface details of the article; and a second source of heat in the form of infra-red radiation, which second source of heat may be the same as the first source of heat, the said second source of heat being comprising at least two, and preferably a plurality in excess of two, of infra-red sources adapted to apply infra-red radiation to the said article with the membrane wrapped therearound, the second source of heat being adjustable both in position and in heating to allow it to heat the membrane and underlying surface of the article over substantially a half-spherical solid angle uniformly to a temperature in excess of the first temperature and for a time sufficient to cause the image to diffuse in liquid form into the surface of the article but insufficient to damage the article.

The apparatus may include one or more of the following features: each infra-red heat source is independently positionable. There are multiple groups of infra-red heat sources, each group being independently positionable. Each infra-red heat source may have its intensity adjusted. There is at least one baffle to direct heat within the apparatus. There is at least one fan to direct heat within the apparatus. There is at least one reflector to direct heat within the apparatus. The intensity and/or the position of the infra-red heat sources is controllable in response to feedback from a temperature sensor in the apparatus. The arrangement of baffle(s), reflector(s) and/or fan(s) is controllable in response to feedback from a temperature sensor in the apparatus. The heat sensor is a passive infra-red sensor. The information from the or each heat sensor is used to control the position(s) of the heat source(s), the baffle(s), the fan (s), and/or the reflector(s). The information from the or each heat sensor is used to control the intensity of the or each heat source. The arrangement of baffle(s), reflector(s) and/or fan(s) and/or the intensity and/or the position of the infra-red heat sources is controllable in order to keep the surface of the article between a predetermined minimum acceptable temperature and a predetermined maximum acceptable temperature during the thermo- and vacuum-forming step. The arrangement of baffle(s), reflector(s) and/or fan(s) and/or the intensity and/or the position of the infra-red heat sources is controllable in order to keep the surface of the article between a predetermined minimum acceptable temperature and a predetermined maximum acceptable temperature during the dye diffusion step.

The carrier membrane comprises a film, the image being printed on to the first side of the film. The carrier membrane comprises a film with a coating applied on to the first side of the film, the image being printed on to the coating. The wavelength (or range of wavelengths) emitted by the infra-red heat sources is tailored to the carrier membrane used. The carrier membrane is designed to soften at low temperature. The carrier membrane is designed to hold its structural form when heated. The carrier membrane is designed to stretch in a consistent fashion.

BRIEF DESCRIPTION OF THE DRAWINGS

Reference may now be made to an embodiment of printing apparatus described hereinbelow by way of example only with reference to the accompanying drawings, in which.

DESCRIPTION OF PREFERRED EMBODIMENTS

Figure 1:
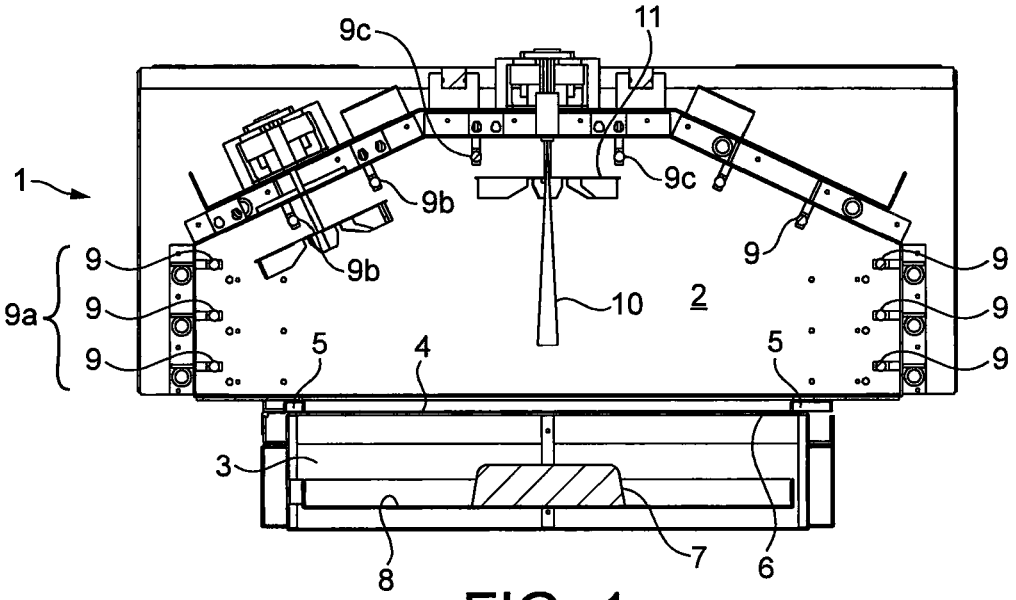
FIG. 1 shows a sectional view of the printing apparatus with an article to be printed in the article receiving chamber.

Referring first to FIG. 1, there is a printing apparatus 1 including a heating chamber 2 and an article receiving chamber 3. Carrier membrane 4 is mounted in a frame 5, and initially lies in a plane separating heating chamber 2 and article receiving chamber 3. First side 6 of membrane 4 has an image digitally printed thereon, preferably as a pattern of pixel dots of dye using a digital micro-piezo head printer. Alternatively, the image may be produced by gravure printing, silkscreen printing or lithio-printing. The article 7 to be printed upon is positioned on a generally flat platen 8 mounted in a plane generally parallel to the plane of the membrane 4. In some embodiments the article 7 may be placed on a nest (not depicted) upon the platen 8, the nest providing support for the article during the printing process. Platen 8 is moveable, and may be moved by any suitable means, including, but not limited to, servo motors, spring based devices, hydraulic devices, pneumatic devices, or counter weights.

The article 7, shown here for simplicity of illustration as a simple three-dimensional block without any surface relief, may take any form, including, but not limited to, a canvas sports shoe, a toy gun with intricate surface relief, or a motorcycle helmet.

Heating chamber 2 contains a number of infra-red sources, in this case infra-red lamps 9. In this embodiment the lamps are arranged in groups 9*a*, 9*b*, 9*c*, etc, each group being independently controllable. Additionally, each individual lamp 9 of a group may be is independently controllable (both in position and in intensity). A heat sensor 10, here a PIR (passive Infra-Red) sensor, monitors the temperature of the heating chamber and feeds that information to a data processor (not shown). Lamps 9, motor driven fans 11 within chamber 2, reflectors (not visible in the drawings), and baffles (omitted from the drawings for clarity), are all controlled by the data processor to keep the temperature of the chamber 2 within pre-determined minimum and maximum temperatures that have been found to be optimal for each stage of the printing process, depending on the membrane used, the ink used, and the nature of the object to be printed. When heated, chamber 2 is sealed, in order that the air circulates but does not escape. Vents could optionally be inserted if desired. Multiple PIR sensors 10 may be used in different areas of the heating chamber 2 as required, in order to obtain a better overview of the temperature in different areas of the chamber. The temperature or temperature range required in the heating chamber will be determined by the nature of the article 7 to be printed, the nature of the carrier membrane 4 used, and the nature of the ink that is being transferred.

The precise nature of the carrier membrane used and the ink used may be chosen to suit the nature of the article, the outcome quality desired, and the budget of the printer, but we have found that the use of so-called "3D Sublimation Film" from the Korean Company, Songjeong Co., Ltd., said to be for use with "sublimation ink", and so-called "sublimation ink" obtained from the American Company, J-Teck USA, Inc., yield good results, although it should be noted that dye transfer is actually by diffusion rather than sublimation. Those involved in the art of transfer printing will readily be able to source alternative inks and membranes, and, where a membrane requires an additional coating to receive the ink, suitable coatings. Digital images may be printed on to the membrane using conventional micro piezo head printing.

To print onto an article, the apparatus is set up generally as shown in FIG. 1. At this stage, the suitable carrier membrane 4 (in this embodiment, "3-D Sublimation Film" from Songjeong Co., Ltd) has already had the desired image printed thereon using an appropriate ink (in this embodiment, "sublimation ink" from J-Teck USA, Inc.) and membrane 4 has been suitably fixed in the apparatus using frame 5. The article 7 is positioned on the platen 8 in the article receiving chamber 3.

Figure 2:
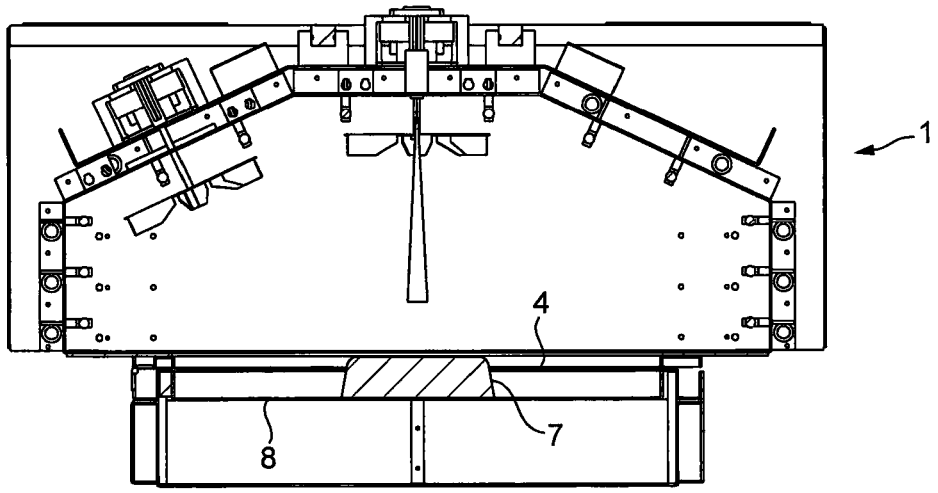
FIG. 2 shows a sectional view of the printing apparatus of FIG. 1 with the article in a raised position in contact with the carrier membrane.

Membrane 4 is heated using Infra-red lamps 9 to soften it. It is heated for around 5-10 seconds until it is between 50 and 87° C. If a different membrane were to be used, a there would be a different optimal temperature range, and a different heating time could be required. The temperature of membrane 4 is monitored by PIR sensor 10 during this stage and the information is fed to a data processor. If the membrane is found to be heating unevenly, or is being heated too quickly or too slowly, the data processor can arrange for the intensities or positions of individual lamps 9 or groups of lamps 9*a*, 9*b* etc. to be adjusted. When the membrane 4 has been suitably softened, platen 8 will raise article 7 from its position in the article receiving chamber 3, which is cooler than the heating chamber, towards the membrane 4 in a direction generally perpendicular to the plane of the membrane in its frame, as depicted in FIG. 2.

Figure 3:
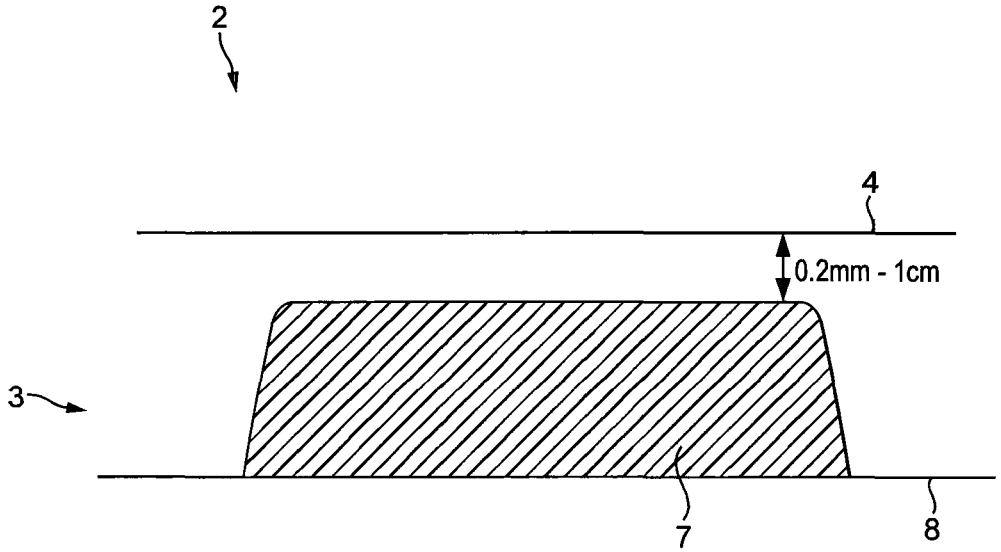
FIG. 3 shows a portion of the apparatus, in which the article has been brought close to the softened membrane.

The movement of platen 8 is paused before the article makes contact with the membrane 4, when the closest part of the article to the membrane is around 0.2 mm to 1 cm from the membrane, as depicted in FIG. 3.

Figure 4:
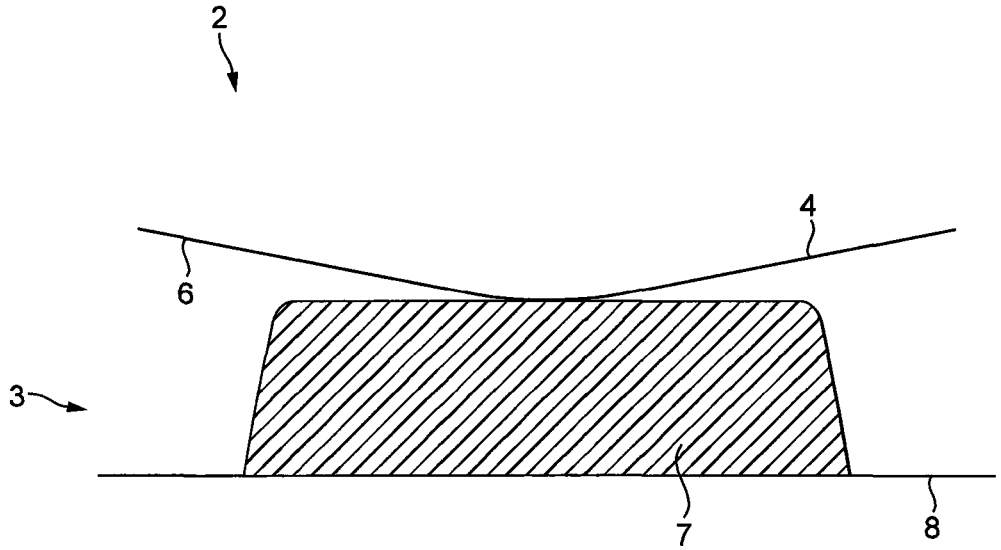
FIG. 4 shows a portion of the apparatus in which a partial vacuum has been created, drawing the softened membrane into contact with the article.

As shown in FIG. 4, article 7 is held between 0.2 mm and 1 cm below the softened membrane 4 while a slight vacuum is created in the article holding chamber 3, the vacuum drawing first side 6 of the softened membrane 4 downwards towards the article 7 and into contact with the upper part of the article, causing accurate registration of the image with the article 7. It should be noted that FIGS. 3 and 4 are not to scale, causing the bend in the membrane to appear severe in FIG. 4. The drawing is purely illustrative; when the membrane and the object are only 0.2 mm-1 cm from each other, the bend caused in the membrane by the vacuum will clearly be far more gentle. Upwards movement of platen 8 is then resumed while the slight vacuum is maintained, and platen 8 moves article 7 through the plane in which membrane 4 originally lay and into heating chamber 2, causing the remainder of the membrane 4 to wrap around article 7 in contact therewith. Now that article 7 is in the heating chamber, the surface of the article itself is heated through the membrane by the array of infra-red lamps 8 disposed substantially over a half-spherical solid angle. A stronger vacuum is caused, drawing membrane 4 into intimate contact with the article. The combination of thermo- and vacuum-wrapping allows good contact between the dye-carrier membrane and the surface details of the article, even where the article has significant surface relief. The combination of close contact between membrane 4 and article 7 and heating from lamps 9 to a higher temperature under control of the PIR sensors allows the dye to diffuse into the surface of the article 7.

Applicant has found that although the above mentioned stronger vacuum is useful for drawing the carrier membrane into intimate contact with the surface of the article, it is preferable to only hold this stronger vacuum for around 15 seconds, before reducing the vacuum strength. Holding a weaker vacuum throughout the dye diffusion step keeps the membrane in contact with the article, but is less likely to cause tearing or perforation of the membrane than the strong initial vacuum employed during the vacuum- and thermo-forming step.

As described, and depicted in FIG. 4, Applicant's adoption of an initial contact between membrane 4 and article 7 allows them accurately to control registration of the image on first side 6 of the membrane with the article 7 in a way that was simply not possible with the prior techniques of Neri, Howell and Hoggard discussed above.

Membrane 4 and the surface of the article 7 are heated in the heating chamber 2 for a time and to a temperature that is sufficient to cause the pixel dots of dye to diffuse in liquid form into the surface of the article but insufficient to damage the article. When Songjeong's film is used in conjunction with J-Teck's ink, the surface temperature should be held between 120-170° C., more preferably between 143-155° C., for 1-4 minutes.

The heating effect of infra-red radiation is focal length sensitive. Accordingly, Applicant arranges the lamps 9 or groups of lamps 9*a*, 9*b* to be moveable to ensure that the surface of article 7 is evenly heated. If an object with a complex shape is to be printed, the use of baffles and reflectors can ensure that an even surface temperature can still be obtained. Position adjustments of lamps, baffles, reflectors, and fans 11 may be made throughout the dye-diffusion step as required. As in the thermo- and vacuum-forming step, the temperature throughout this step is monitored by one (and preferably more than one) PIR sensor 9, and is fed to a data processor. The data processor is coupled to the infra-red lamps or groups of infra-red lamps to adjust their position and intensity, as necessary. As shown in FIGS. 1 and 2, infra-red lamps 9 are distributed around substantially a half-spherical solid angle around the article 7 in its position within the heating chamber 2, having passed through the initial plane of the membrane.

It is desirable to achieve effective dye transfer without raising the average temperature of the article 6 too much, for a number of reasons. Firstly, once the dye-diffusion step is completed the article and membrane must be cooled, and the membrane 4 removed. The cooling step can take some time, and clearly the higher the average temperature of the object the longer the cooling step will take. If too high a temperature is required for too long, a process may be unsuitable for certain types of article, particularly, but not limited to, plastics that soften when heated and therefore may distort.

Applicant's careful positioning of infra-red lamps 9, fans 10 (and baffles, reflectors etc. for more complex shaped articles) enables them to heat the membrane and the very outer surface of the article during the dye-diffusion step without heating up the entire body of the article as much. In addition, the initial heating of the membrane for thermo- and vacuum-forming is performed with the article on the other side of the membrane from the heating chamber and held some way away. Previous printing methods have needed to heat the entire article for longer periods of time.

Improved results are achieved by tailoring the wavelength (or range of wavelengths) emitted by the infra-red heat lamps 9 to the carrier membrane 4 used. If membrane is more susceptible to the radiation used, then efficient dye-transfer may be achieved before the temperature of the entire object has had a chance to heat up as much.

Where the article is coated to receive diffused dyes, the coating may be selected having regard to the wavelength of the infra-red radiation so that it heats without significantly heating the material of the underlying article.

The invention claimed is:

1. A process for printing on to a 3-dimensional article, the process comprising the steps of:

(i) printing an image on to a first side of a stretchable carrier membrane having a first side and a second side;

(ii) mounting the membrane in a plane within a frame between a heating chamber defined on one side of the membrane, being the said second side thereof, and an article receiving chamber defined on the other side of the membrane, being the said first side thereof;

(iii) placing a 3-dimensional article to be printed on to a generally flat platen positioned generally parallel to the said plane within the article receiving chamber;

(iv) performing a thermo- and vacuum-forming step comprising:

(a) relatively moving the platen with respect to the membrane in a direction perpendicularly to the said plane to bring the article into register with the image printed on the membrane, and carrying the article into intimate contact with the membrane through the plane into the heating chamber, (b) applying a source of vacuum to the membrane from the other side, and (c) applying heat to the membrane from the said one side at a first temperature sufficient to soften the membrane, whereby the membrane is thermo- and vacuum-wrapped at least partially about the article with the membrane in intimate contact with surface details of the article; and (v) a dye-diffusion step in which infra-red radiation is applied to the article with the membrane wrapped therearound using at least two, and preferably a plurality in excess of two, of infra-red sources to heat the membrane and underlying surface of the article over substantially a half-spherical solid angle uniformly to a temperature in excess of the first temperature and for a time sufficient to cause the printed image to diffuse into the surface of the article but insufficient to damage the article;

wherein the thermos- and vacuum-forming step (iv) further comprises:

(aa) pausing or slowing the movement of the platen before the article has passed through the said plane when the article is around 0.2 mm to 1 cm from the membrane, (bb) drawing the membrane to register with the article by application of a partial vacuum on the first side of the membrane to draw the membrane, and (cc) then resuming the movement of the platen to pass the article through the said plane, while maintaining the partial vacuum.

2. A process according to claim 1, wherein the thermo- and vacuum-forming step (iv) further comprises:

(dd) creating a stronger vacuum than said partial vacuum once the article is on the heating chamber side of the said plane.

3. A process according to claim 2, wherein the thermo- and vacuum-forming step further comprises:

(ee) maintaining the stronger vacuum for a predetermined period of time while the article is on the heating chamber side of the said plane, and (ff) then reducing the vacuum to a lower predetermined strength.

4. A process according to claim 1, wherein the heat in the apparatus is controlled by altering the intensity and/or the position of the/each heat source, in response to information from a heat sensor.

5. A process according to claim 1, wherein the heat in the apparatus is controlled by the use of baffle(s), and/or reflector(s) and/or fan(s), in response to information from a heat sensor.

6. A process according to claim 1, wherein the membrane has a coating on said first side adhered to the remainder of the membrane, the coating being selected to receive said image in said printing step.

7. A process according to claim 1, wherein the surface proper of the 3-dimensional article to be printed is incapable of receiving the printed image, and wherein an additional preliminary step is performed to coat the article with a coating which adheres to said surface proper, the said coating of said preliminary step being capable of accepting the printed image by diffusion into the material of the said coating in said dye-diffusion step.

8. A process according to claim 7, wherein said coating exhibits grain boundaries, whereas the surface proper of the 3-dimensional article does not.

9. A process according to claim 7, wherein said coating is tailored to a wavelength or range of wavelengths of infra-red radiation used.

10. A process according to claim 1, wherein the generally flat platen has a nest for the article thereon.

11. A process according to claim 1, wherein a wavelength or range of wavelengths of the infra-red radiation is tailored to the membrane used.

12. An apparatus for printing on to a 3-dimensional article; the apparatus comprising:

a heating chamber, an article receiving chamber, and a frame adapted to mount a stretchable carrier membrane having a first side and a second side in a plane separating the heating chamber from the article receiving chamber, the membrane having an image printed on to its first side;

a generally flat platen positioned generally parallel to the said plane within the article receiving chamber;

a mechanism for causing relative movement of the platen with respect to the membrane in a direction perpendicularly to the said plane to bring an article mounted on the platen into register with a said image printed on the first side of a said membrane held in the frame, and to carry the said article into intimate contact with the membrane through the said plane into the heating chamber;

a source of vacuum associated with the article receiving chamber and adapted to apply a vacuum to the membrane held in the frame from the side of the article receiving chamber;

a first source of heat in the heating chamber adapted to apply heat to the membrane held in the frame at a first temperature sufficient to soften the membrane, whereby, in concert with said vacuum source, to thermo- and vacuum-wrap the membrane at least partially about the said article with the membrane in intimate contact with surface details of the article; and a second source of heat in the form of infra-red radiation, which second source of heat may be the same as the first source of heat, the said second source of heat comprising at least two, and preferably a plurality in excess of two, of infra-red sources adapted to apply infra-red radiation to the said article with the membrane wrapped therearound, the second source of heat being adjustable both in position and in heating to allow it to heat the membrane and underlying surface of the article over substantially a half-spherical solid angle uniformly to a temperature in excess of the first temperature and for a time sufficient to cause the image to diffuse in liquid form into the surface of the article but insufficient to damage the article:

wherein the mechanism is constructed and arranged to cause said relative movement in two stages, namely a first stage which ends before the article has passed through said plane when the article is around 0.2 mm to 1 cm from the membrane, and a second stage which commences when the membrane has been drawn into register with the article by a partial vacuum created by said source of vacuum on the first side of the membrane and ends when the article has passed through said plane.

13. An apparatus according to claim 12, wherein the apparatus further comprises baffle(s), and/or reflector(s) and/or fan(s) to direct heat within the apparatus.

14. An apparatus according to claim 13, wherein the apparatus further comprises at least one heat sensor, and the intensity of the fan(s) And/or the position of the baffle(s), and/or reflector(s) and/or fan(s) is(are) controllable in response to feedback from the or each heat sensor.

15. An apparatus according to claim 12, wherein the apparatus further comprises at least one heat sensor, and the intensity and/or the position of the or each source of heat is controllable in response to feedback from the or each heat sensor.

16. An apparatus according to claim 12, wherein the generally flat platen has a nest for the article thereon.

* * * * *